United States Patent [19]

Bitel

[11] Patent Number: 4,577,773

[45] Date of Patent: Mar. 25, 1986

[54] UTILITY BOX

[75] Inventor: Vincent J. Bitel, Rockfall, Conn.

[73] Assignee: The Rogers Manufacturing Co., Rockfall, Conn.

[21] Appl. No.: 639,451

[22] Filed: Aug. 10, 1984

[51] Int. Cl.[4] ..... B65D 25/06

[52] U.S. Cl. ..... 220/22.3; 220/22; 206/561; D7/38; D34/45

[58] Field of Search ..... 220/22, 22.1, 22.2, 220/22.3; 206/561; D7/38, 70; D34/45, 46

[56] References Cited

U.S. PATENT DOCUMENTS

| | | | |
|---|---|---|---|
| 348,839 | 9/1886 | Grosz . | |
| 1,562,074 | 11/1925 | Baum . | |
| 1,840,485 | 1/1932 | Butler . | |
| 2,645,127 | 7/1953 | Parks | 220/22.3 |
| 2,919,021 | 12/1959 | Robinson | 206/561 |
| 3,032,381 | 5/1962 | Boro . | |
| 3,200,983 | 8/1965 | Walter . | |
| 3,223,237 | 12/1965 | Harrod, Jr. et al. . | |
| 3,227,504 | 1/1966 | Dunham . | |
| 3,283,915 | 11/1966 | Maslow . | |
| 3,305,076 | 2/1967 | Fleenor . | |
| 3,353,704 | 11/1967 | Belcher et al. . | |
| 3,554,429 | 1/1971 | Cohen . | |
| 3,581,906 | 6/1971 | Joyce . | |
| 3,920,144 | 11/1975 | Callen . | |
| 4,040,539 | 8/1977 | Patterson . | |
| 4,164,309 | 8/1979 | Staats . | |
| 4,248,349 | 2/1981 | Locke | 206/561 |
| 4,372,444 | 2/1983 | LeGrand | 220/22.3 |
| 4,436,215 | 3/1984 | Klienert | 220/22.3 |

FOREIGN PATENT DOCUMENTS

| | | | |
|---|---|---|---|
| 1603163 | 3/1972 | France | 220/22.3 |
| 820128 | 9/1959 | United Kingdom | 220/22.3 |
| 892677 | 2/1962 | United Kingdom | 220/22.3 |

*Primary Examiner*—George E. Lowrance

[57] ABSTRACT

A utility box for storing small parts and the like has a container molded from a transparent plastic material exhibiting natural flexural characteristics with a generally rectangular configuration defined by a bottom wall and upwardly extending and outwardly tapering side and end walls. The bottom wall has a multiplicity of transversely extending ribs thereon each formed with concave side surfaces and a planar upper surface with a groove therein. The side walls of the container have pairs of aligned slots therein above the ribs of the bottom wall and recesses in the outer surface of the side wall above the slots. The side walls are also provided with pairs of aligned ribs extending upwardly from adjacent the bottom wall to the slots to form channels therebetween. A multiplicity of removable compartment dividers matingly received are seated within the grooves and channels therein, and arm portions at the upper edges thereof lock into the slots of the side walls.

8 Claims, 8 Drawing Figures

UTILITY BOX

BACKGROUND OF THE INVENTION

The present invention relates generally to storage containers and the like, and more particularly to rectangular storage containers or boxes having removable compartment dividers.

Storage cabinets having a multiplicity of molded plastic drawers or trays therein have been utilized for a number of years for storing small parts such as screws, nails, nuts, bolts, washers and the like. Some drawers for such cabinets are provided with vertically extending aligned grooves or other seating means in the opposed side walls which removably seat compartment dividers so as to form a multiplicity of storage areas which permit a varying variety of sizes or styles of small parts to be stored and categorized in a single drawer.

One of the major drawbacks of such prior art drawers or trays has been that the side edges of the compartment dividers are generally loosely held in their seats so that the dividers may move vertically. If this divider rises sufficiently, the small parts in adjacent storage areas may slip beneath the divider and comingle, thereby requiring the user to undertake the time consuming task of resorting the parts and undermining the purpose of providing the dividers.

Another problem associated with such compartment dividers has been that the lower edge has not been retained against lateral deflection. If there is a heavy load on one surface, there may occur deflection along the length of the divider sufficient to produce such a gap under the divider and allow comingling of the stored parts.

Finally, the dividers in the drawers generally meet the bottom wall at a right angle. Stored there parts such as small washers kept in a drawer become very difficult to remove since the storage areas are generally small in size and the parts tend to lodge in the sharp corner between the divider and the bottom wall.

It is an object of the present invention to provide a novel utility box having a multiplicity of compartment dividers for storing small parts and the like.

It is also an object to provide such a box which inhibits both lateral deflection and vertical movement of the dividers therein to prevent comingling of the stored parts.

A further object is to provide such a box which facilitates the removal of the stored parts from the compartments.

SUMMARY OF THE INVENTION

It has now been found that the foregoing and related objects can be readily attained in a utility for having a generally rectangular configuration defined by a generally rectangular bottom wall and a pair of opposed end walls and a pair of opposed side walls extending upwardly from the bottom wall to provide a generally rectangular cavity. The side walls have aligned vertically extending slots in the upper edges thereof, and a plurality of compartment dividers extending between the side walls and have engagement arm portions adjacent their upper edges which extend through the slots and engage the side walls to maintain the dividers and side walls in assembly. The engagement arm portions are provided with outer surface finger portions extending generally parallel to the side walls and abutting the side walls.

Preferably, the side walls have pairs of vertically extending ribs on the inner surface thereof along the sides of the slots to form channels which seat the side edges of the dividers. These ribs extend along the inner surfaces of the side walls from adjacent the bottom wall to at least the associated slot.

Ideally, the bottom wall has transversely extending upstanding ribs adjacent the dividers and the dividers are seated thereon. The transversely extending side surfaces of each of the ribs is concave, and the ribs desirably have a groove in their upper surface which seats the lower edge of the dividers. The lower edge of each of the dividers desirably has a lip portion of lesser thickness than the body of the dividers, and this lip portion is cooperatively dimensioned with respect to the groove of the ribs on the bottom wall to seat therein.

Conveniently, the outer surfaces of the side walls have recesses therein extending along the slots and seating the finger portions of the dividers.

In the preferred embodiment, the box is a drawer having a manually engageable handle on one of the end walls and an abutment means on the other of the end walls thereof for use in combination with a metallic storage cabinet.

DETAILED DESCRIPTION OF THE ILLUSTRATED EMBODIMENT

Figure 1:
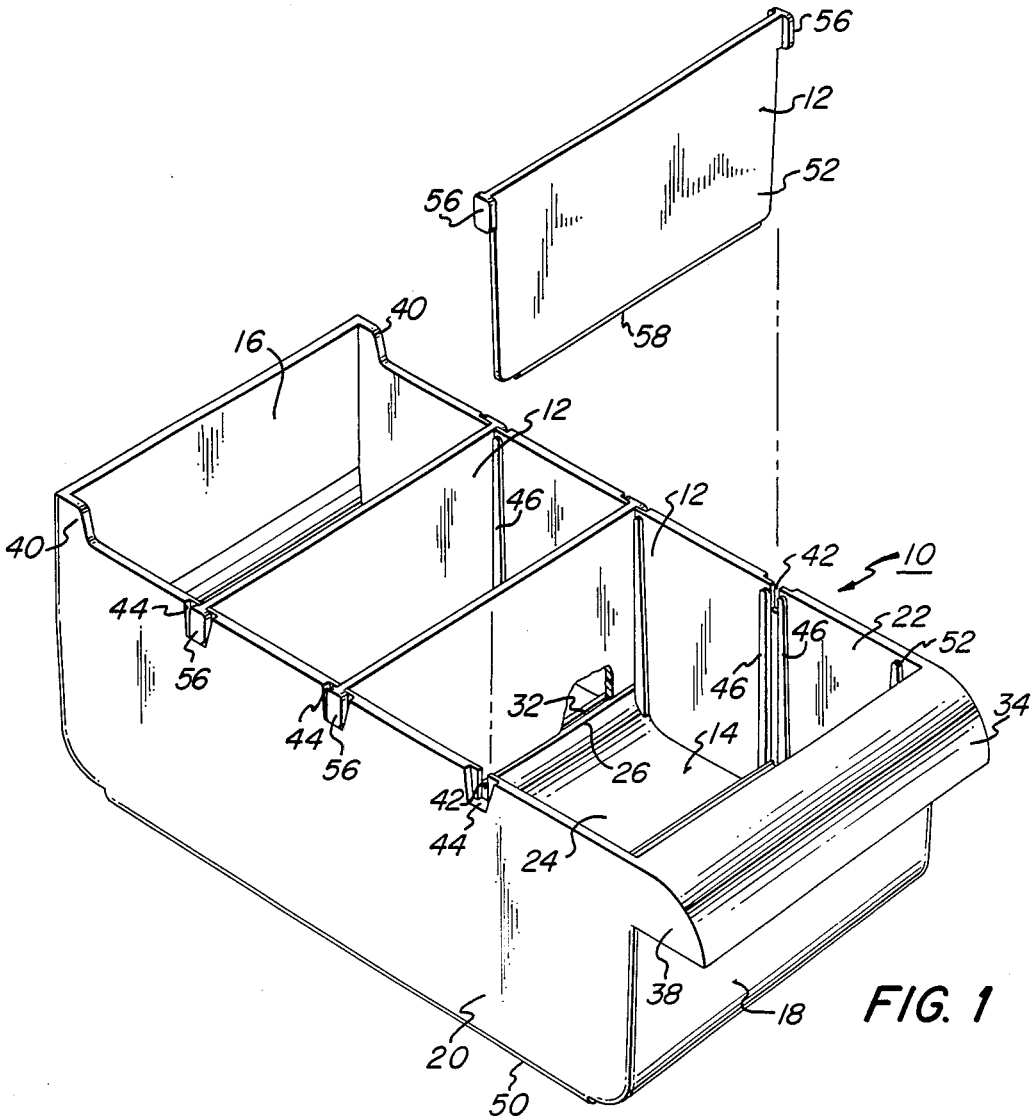
FIG. 1 is a perspective view of a utility box embodying the present invention with one of the compartment dividers being removed from the container and another divider partially broken away to show internal structure.

Referring first to FIG. 1, therein illustrated a utility box embodying the present invention and comprised of a container generally designated by the numeral 10 and a multiplicity of dividers generally designated by the numeral 12. The container 10 is in the form of a drawer for use in combination with a utility storage cabinet (not shown).

Figure 2:
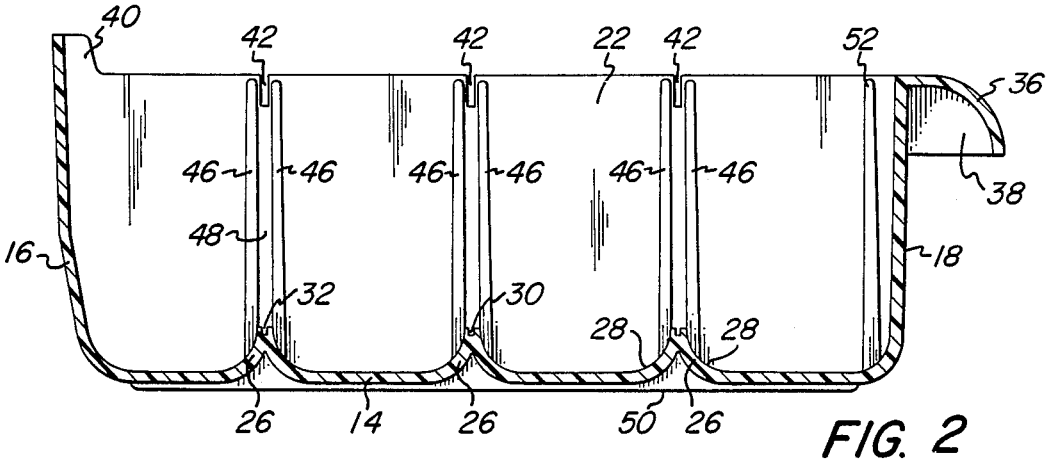
FIG. 2 is a longitudinal sectional view of the container of FIG. 1.

As best seen in FIGS. 1 and 2, the container 10 has a generally rectangular bottom wall 14, and extending upwardly and tapering slightly outwardly from the bottom wall 14 are a pair of end walls 16, 18 and a pair of side walls 20, 22, thereby defining a generally rectangular cavity 24. The bottom wall 14 has three upstanding ribs or land portions 26 spaced therealong and extending transversely between the side walls 20, 22. Each of the ribs 26 has concave side surfaces 28 and a generally planar upper surface 30 in which there is a transversely extending groove 32.

Molded on the end wall 16 is a manually engageable handle 34 for manipulating the container 10 when used as a drawer in combination with an associated storage cabinet. The handle 34 has a downwardly sloping finger engageable portion 36 with side flanges 38 at the ends thereof. The other end wall 18 is of increased height so that it extends above the side walls 20, 22 and provides abutment portions 40 which operatively engage a stop on an associated storage cabinet to limit longitudinal movement of the container 10 outwardly therefrom.

Figure 3:
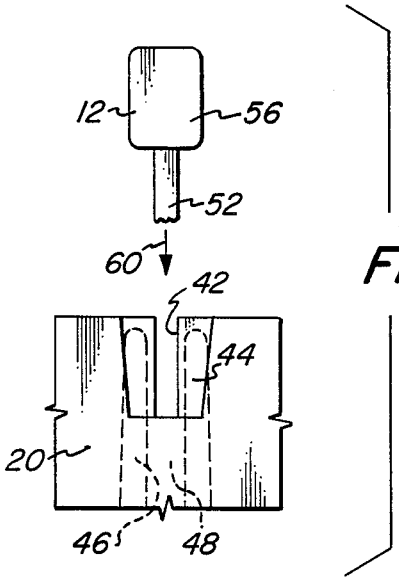
FIG. 3 is a fragmentary side elevational view of the container to an enlarged scale with a fragmentarily illustrated divider being inserted into assembly.
Figure 4:
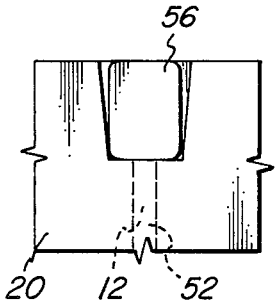
FIG. 4 is a fragmentary side elevational view similar to FIG. 3 with the divider in assembly with the container box.

The upper portions of the side walls 20, 22 above the ribs 26 on the bottom wall 18 have aligned pairs of slots 42 and the outer surfaces of the side walls 20, 22 have recesses 44 therein about the slots 42, and the sides of the recesses diverge upwardly as illustrated in FIG. 3.

Aligned on the inner surfaces of the side walls 20, 22 are pairs of ribs 46 extending vertically from adjacent the bottom wall 14 to at least the associated slot 42 and forming channels 48 therebetween. The side walls 20, 22 extend below the bottom wall 14 to provide surfaces 50 upon which the box can slide within an associated storage cabinet. The side walls 20, 22 also have vertically extending ribs 52 adjacent the front end wall 18 which permit insertion of an identification label or tag (not shown) between the ribs 52 and the front wall 18.

Turning now to FIG. 2, therein illustrated in detail is a compartment divider 12 used in conjunction with the container 10 to form the compartments of the utility box. The divider 12 has a planar body portion 52 with side edges tapering outwardly to match the taper of the side walls 20, 22. Engagement arm portions 54 extending outwardly from the side edges adjacent the top edge, and the outer ends of these arm portions 54 have finger portions 56 thereon which extend normally thereto. Extending along the lower edge of the divider 12 is a lip portion 58 of lesser thickness and length than the body portion 52.

Illustrated in FIGS. 3–6 is the method of inserting the dividers 12 into the container 10 to form the utility box. The divider 12 is inserted in the direction indicated by the arrow 60 in FIGS. 3 and 5 into the channel 48 formed by the ribs 46. When the divider 12 is fully inserted into the container 10, the matching tapers on the side walls 20, 22 and the side edges of the divider 12 provide a snug fit therebetween, and the arm portions 54 seat in the slots 42 with the finger portions 56 seating in the recesses 44.

Preferably, the distance between inner surfaces of an aligned pair of recesses 44 is greater than the distance between inner surfaces of the fingers 56. As a result, the natural resiliency or flexural characteristics of the side walls 20, 22 permits the divider 12 to "snap" or "lock" into place to hold the components in firm assembly and prevent spreading of the top edges of the side walls 20, 22. The recesses 44 allow the outer surfaces of the finger portions 56 to be flush with the outer surfaces of the side walls 20, 22.

Figure 5:
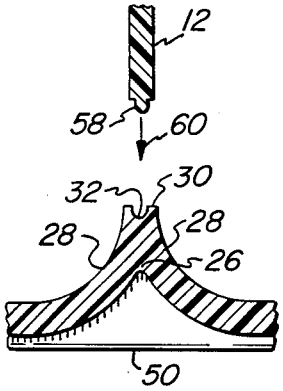
FIG. 5 is a fragmentary longitudinal sectional view to an enlarged scale of a portion of the bottom wall of the container with a divider being inserted into assembly.
Figure 6:
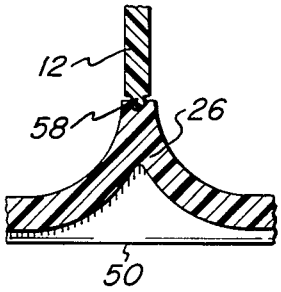
FIG. 6 is a fragmentary sectional view similar to FIG. 5 with the divider in assembly.
Figure 7:
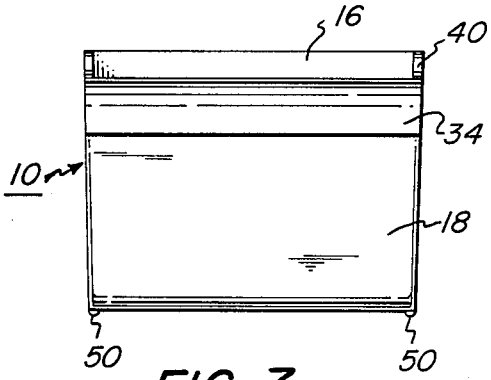
FIG. 7 is an end elevational view of the utility box of FIG. 1.
Figure 8:
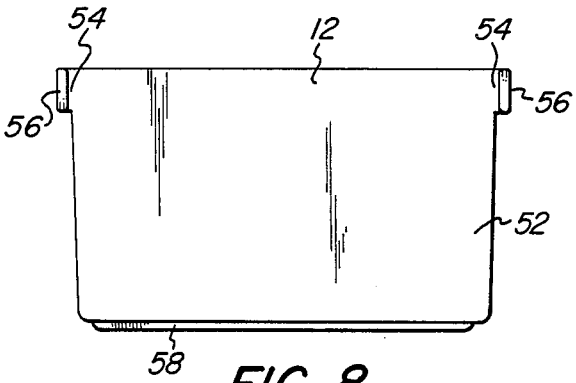
FIG. 8 is an elevational view of a compartment divider.

As seen in FIGS. 5 and 6, the lip portion on the bottom edge of the dividers 12 fits snugly into the groove 32 to inhibit lateral movement or deflection of the lower edge of the divider 12. To remove the divider 12, the procedure is simply reversed.

Once the desired number of dividers 12 is inserted into the container 10 to form a multiplicity of storage areas, items (not shown) to be stored such as small washers can be placed therein. To remove such an item, the user can simply slide the item across the bottom wall 14 and up the associated concave surface 28 until the item can be gripped. In the event that the container 10 is utilized with some or all of the dividers 12 removed, the upwardly extending concave surfaces 28 on the bottom wall 14 will still facilitate removal of the stored parts.

The container 10 and the dividers 12 are preferably molded from a transparent plastic resin such as polyethylene, polypropylene, high impact polystyrene, impact modified acrylic, or the like but it should be apparent to those skilled in the art that these components may be manufactured from other suitable materials which exhibit the desired resiliency to permit the locking engagement of the dividers and the main body.

Thus, it can be seen from the foregoing specification and the attached drawings that the utility box of the present invention provides an effective means for locking the dividers to the container member and facilitating removal of stored parts therefrom.

I claim:

1. A utility box having a generally rectangular configuration comprising:

A. a container having a generally rectangular bottom wall, and a pair of end walls and a pair of side walls extending upwardly from said bottom wall and defining a generally rectangular cavity, said side walls having aligned slots extending through the upper edges thereof, said side wall having opposed pairs of vertically extending ribs on the inner surface thereof aligned with said slots to form channels said bottom wall having upstanding ribs extending transversely between said side walls; and B. a plurality of compartment dividers extending between said side walls of said container member and having engagement arm portions adjacent the upper end thereof extending through said slots and having flange portions exending along the outer surface of said side walls about said slots to maintain said dividers and side walls in assembly, said dividers having their side edge portions seated in said channels of said side walls and their bottom edges seated on ribs of said bottom wall, said dividers being of a height not greater than that of said container.

2. The utility box in accordance with claim 1 wherein said flanges of said engagement arm portions have finger portions on the outer end thereof extending generally parallel to said side walls and abutting said side walls.

3. The utility box in accordance with claim 1 wherein said ribs on said side walls extend along said inner surfaces of said side walls from adjacent said bottom wall to at least the bottom end of said slots.

4. The utility box in accordance with claim 1 wherein said ribs on said bottom wall have concave surfaces extending transversely thereof on each side of said divider to provide surfaces sloping upwardly to said dividers.

5. The utility box in accordance with claim 1 wherein each of said ribs on said bottom wall has a groove in its upper surface seating the lower edge of said divider.

6. The utility box in accordance with claim 5 wherein said lower edge of each of said dividers has a lip portion of lesser thickness than the body of said divider, said lip portion being seated in said groove of said rib on said bottom wall.

7. The utility box in accordance with claim 2 wherein the outer surfaces of said side walls have recesses therein extending about said slots and seating said finger portions of said dividers.

8. The utility box in accordance with claim 1 wherein said box is a drawer having a manually engageable handle on one of said end walls and an abutment portion at the other of said end walls.

* * * * *